US005398623A

United States Patent [19]

Lautenschlager et al.

[11] Patent Number: 5,398,623

[45] Date of Patent: Mar. 21, 1995

[54] METHOD FOR INCINERATING REFUSE, AND A CONTROL PROCESS THEREFOR

[75] Inventors: Gert Lautenschlager, Margetschöchheim; Ulrich Kaiser, Würzburg, both of Germany; Robert Steiner, Bassersdorf; Erwin Wachter, Zürich, both of Switzerland; Bernhard Fabian, DN-Heelsum, Netherlands

[73] Assignee: Noell Abfall- und Energietechnik GmbH, Neuss, Germany

[21] Appl. No.: 180,910

[22] Filed: Jan. 13, 1994

[30] Foreign Application Priority Data

May 13, 1992 [DE] Germany ..... 42 15 997.0

[51] Int. Cl.[6] ..... F23G 5/00

[52] U.S. Cl. ..... 110/346; 110/101 C; 110/101 CD; 110/186

[58] Field of Search ..... 110/101 C, 101 CD, 185, 110/186, 346

[56] References Cited

U.S. PATENT DOCUMENTS

| | | | |
|---|---|---|---|
| 4,385,567 | 5/1983 | Voss | 110/186 |
| 4,895,082 | 1/1990 | Mindermahn et al. | 110/186 |
| 5,280,756 | 1/1994 | Labbe | 110/186 X |

FOREIGN PATENT DOCUMENTS

| | | | |
|---|---|---|---|
| 2446724 | 4/1975 | Germany . | |
| 4028486 | 5/1992 | Germany . | |
| 51-127579 | 11/1976 | Japan . | |
| 52-36874 | 3/1977 | Japan . | |
| 55-012368 | 3/1980 | Japan . | |
| 55-35873 | 3/1980 | Japan . | |
| 55-46359 | 4/1980 | Japan . | |
| 0155108 | 12/1980 | Japan | 110/101 CD |

*Primary Examiner*—Edward G. Favors
*Attorney, Agent, or Firm*—Nils H. Ljungman & Associated

[57] ABSTRACT

In refuse incineration, it has been determined that the legal requirements governing refuse incineration can be more easily met by maintaining a uniform depth of charge on the grate. The charging of the refuse and the transport speed of the charge produced by movable refuse feeders can be regulated as a function of the quantity of refuse in the incinerator or in its individual zones. The load of the drive mechanism can be used for measurement and control purposes for maintaing a uniform refuse depth.

17 Claims, 3 Drawing Sheets

METHOD FOR INCINERATING REFUSE, AND A CONTROL PROCESS THEREFOR

This application is a continuation-in-part application of International Application No. PCT/DE93/00400, filed on May 7, 1993, which claims priority from Federal Republic of Germany Patent Application No. P 42 15 997.0, filed on May 13, 1992. International Application No. PCT/DE93/00400 was pending as of the filing date of U.S. application Ser. No. 08/180,910 and the U.S. was an elected state in International Application No. PCT/DE93/00400.

BACKGROUND OF THE INVENTION

1. Field of the Invention

In incineration systems for the incineration of refuse, it is generally desirable that both the exhaust gases and also the particulates, that is flue dust and ashes, are burned as completely as possible. The energy generated during such an incineration process can often be utilized for additional functions, such as generating steam for operating a turbine, etc. In order to insure that the incineration process is efficient, it can be desirable to regulate the quantity of refuse or the depth of the refuse layer on the grates within a refuse incinerator system.

2. Background Information

The grate disclosed in German Patent No. DE 24 46 724 C 3 can be considered an example of one type of incinerator grate which can be used for the incineration of refuse. The grate described therein consists of several grate zones, which comprise both stationary and movable grate bars which overlap one another like roof tiles. The movable grate bars of one zone are simultaneously hydraulically retracted and advanced, to move the charge through the furnace and also to rearrange the charge. To achieve a uniform transport of the charge, all the grate bars are moved at essentially the same speed. The present invention is, however, not restricted to only the combustion grates as disclosed by DE 24 46 724 C 3.

The operation of a refuse incinerator is particularly difficult, in comparison to the operation of coal-fired, oil-fired or gas-fired systems, because the fuel, i.e. the refuse, varies in terms of its composition and combustion properties. The operation of a refuse incinerator can therefore be subject to constant and sometimes extreme fluctuations.

In order to provide approximately constant incineration conditions and safe and reliable operation, essentially constant adjustments of the firing as a function of the fuel which is introduced need to be made. Some of the considerations which can affect the firing conditions include differences in piece size, density, moisture content, net calorific value and flammability of the refuse being burned.

Now and in the future, the principal objective of refuse incineration is the disposal of refuse and the processing of recyclable materials. Therefore, the primary emphasis should essentially be placed on the reduction and elimination of harmful or toxic substances. The energy generated is no longer an urgent necessity, but remains a desirable byproduct.

The most important objective of the incineration should therefore be considered to be the burning of both the exhaust gases and also the particulates, that is, flue dust and ashes, as completely as possible.

These requirements can ultimately only be met by maintaining approximately constant operating, or combustion conditions during the incineration process. Compliance with new legal requirements makes the maintenance of constant combustion conditions increasingly important.

It is known that the incineration of refuse which entails severe fluctuations in calorific value tends to overload or underload the grates. For example, if the calorific value of the refuse decreases on account of an increased proportion of wet or inert material, the heat released and the quantity of steam generated are typically also reduced. Therefore, in order to compensate, additional refuse is typically added to the combustion chamber, whereby the grates can become overloaded.

An incineration regulation system which aims at constant steam production will therefore typically increase the amount of refuse charged into the incinerator when there is a decrease in the calorific value of the refuse. But, as mentioned above, this hcan often lead to an overloading of the grate, and instead of the desired increase in temperature, there can instead be a further reduction of the combustion chamber temperatures, as insufficient burning may result. Moreover, such an overloading can tend to lead to a "trash heap" on the grate, which trash heap can be transported through the incinerator and can ultimately results in ashes which are incompletely burned.

On the other hand, when the refuse has a high net calorific value, the typical response is to decrease the amount of refuse being fed onto the grates, to attempt to bring about a reduction in the heat being generated. However, when the refuse feed is decreased, there can be a danger that if the amount of refuse charged into the incinerator is excessively reduced, there will be "holes" in the layer of refuse on the grate. Such "holes" can results in the escape of cold combustion air, along with plumes of CO, through the layer and up the exhaust stacks.

OBJECT OF THE INVENTION

The object of the present invention is therefore to keep the amount of refuse or the depth of the refuse layer on the combustion grate approximately constant, regardless of the net calorific value of the refuse, to thereby prevent an overloading or underloading of the grate, and reduce the occurrences of the consequences indicated above.

SUMMARY OF THE INVENTION

The invention teaches that this problem can be solved by regulating the charging of the grate and the speed of the grate as a function of the amount of refuse lying on the grate.

One manner in which this can be done is by measuring the resistance to the drive mechanism which feeds the refuse through the incinerator. For example, on a grate drive system, as previously described, the hydraulic pressure for driving the grates can be monitored, to essentially provide an indication of the weight, or indirectly, the amount of refuse present thereon.

In systems wherein there are a number of consecutively arranged movement zones, such as grate zones, the method of control can vary. For example, a system could be provided for controlling the feed of all of the zones as a function of the resistance provided at the possibly only the zone. Alternately, a system could be provided wherein the the feed rate at any one particular zone could be controlled as a function of the resistance at a subsequent zone, or even of the resistance at that one particular zone.

In essence, one manner in which the feed at any one particular zone can be controlled would be by adjusting the power supplied to the feeder. In instances wherein the feed is done using hydraulics, such as for the earlier described hydraulic systems, the hydraulic pressure applied to the grates could be regulated.

One aspect of the invention reside braodly in a method for incinerating refuse in an incineration apparatus to minimize pollutants in the exhaust and minimizes ash produced during the incineration. The incineration apparatus comprises at least one zone therein for incinerating refuse, and the method comprises the steps of: predetermining a substantially optimum quantity of refuse to be present in the at least one incineration zone for the incineration, the substantially optimum quantity being a quantity which minimizes ash and exhaust pollutants produced during the incineration; providing refuse to the incineration apparatus; charging an amount of refuse into the at least one incineration zone; feeding the refuse charge through the at least one incineration zone at a speed of refuse transport; measuring the quantity of refuse in the at least one incineration zone; incinerating the refuse in the incineration apparatus to produce ash and exhaust gases; regulating at least one of: the charging of refuse into the at least one incineration zone, and the feeding speed through the at least one incineration zone as a function of the quantity of refuse measured in the at least one incineration zone; and maintaining the substantially optimum quantity of refuse in the at least one incineration zone by the regulating of at least one of: the charging and the feeding speed, to minimize ash and exhaust pollutants produced by the incineration.

Another aspect of the invention resides broadly in a process for regulating the quantity of refuse or the depth of the refuse layer on at least a first incinerator grate of an incinerator for incinerating refuse. The process comprises: charging an amount of refuse onto the first incinerator grate; feeding the refuse charge along the first incinerator grate at a speed of refuse transport during the incineration; measuring the quantity of refuse on the first incinerator grate; regulating at least one of: the charging of refuse onto the first incinerator grate, and the feeding speed along the first incinerator grate as a function of the quantity of refuse measured on the first incinerator grate.

BRIEF DESCRIPTION OF THE DRAWINGS

The preferred embodiments of the invention are discussed in further detail below with reference to the accompanying figures, in which.

DESCRIPTION OF THE PREFERRED EMBODIMENTS

Figure 1:
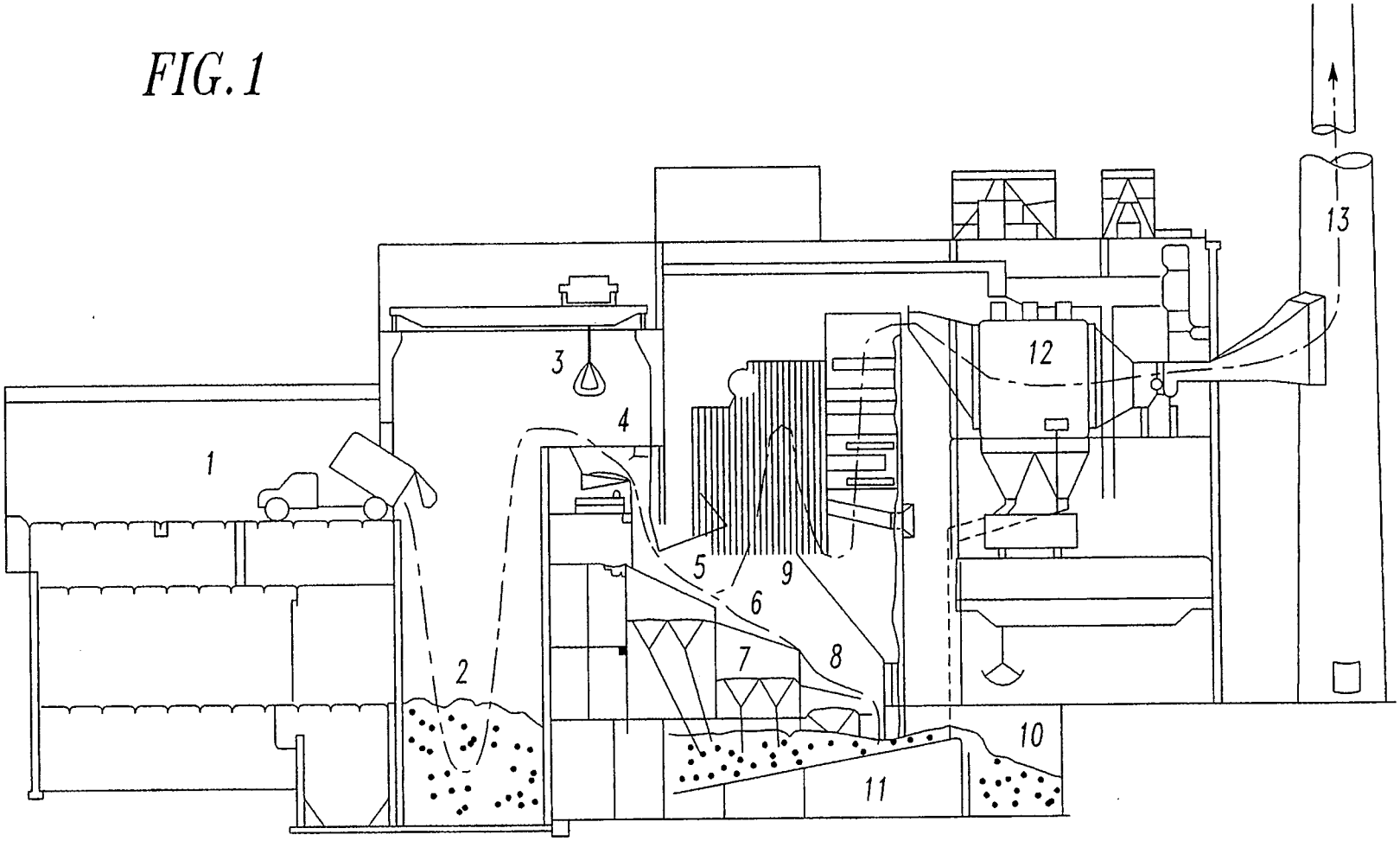
FIG. 1 is a diagram of a typical modern municipal waste incinerator.

FIG. 1 is a diagram of a refuse incinerator having heat recovery in the form of steam generation. Such a system can typically be used to incinerate general household, solid wastes, or commercial and industrial waste or rubbish, and can typically be composed of three main areas: the front-end system, the thermal system, and the discharge system. The depicted refuse incinerator is a diagram of an RESCO facility in Saugus, Mass. In such an incinerator, the front-end system typically will have an unloading shed 1, wherein trucks can preferably enter to unload the refuse into a refuse pit 2. The refuse pit 2 can thereby serve as a storage area for any refuse which is to be burned. From the refuse pit 2, a loading crane 3 can preferably be used to transfer the refuse to a feeder 4, which feeder 4 can be a vibrating feeder. From the feeder 4, the refuse enters the thermal system of the incinerator.

As illustrated, one such arrangement for the thermal area can preferably have a number of incineration grates 5, 6 and 8. Of these grates, the first grate 5 onto which the refuse is deposited can typically be termed the drying grate 5. From the drying grate 5, the refuse can preferably be moved to what can be termed the combustion grate 6, and from the combustion grate 6, the at least partially burnt refuse can be moved to what can be termed a burnout grate 8. The transport from one grate to the next can be brought about by some form of grate movement apparatus, generally indicated as 7 in the figure. The exhaust produced by the combustion can preferably be utilized as a heat source, and in this regard can be fed to a boiler section 9 for heating a water supply. One example of a use for any steam generated in the boiler section 9, would be to drive a steam turbine for generating electricity, etc.

The discharge system of such an incineration system can have basically two parts, a solid discharge area and a gaseous discharge area. The solid discharge area would generally be disposed adjacent the burnout grate 8, to receive the solid ash residue left over form the incineration. There can also preferably be a residue collection area 11 for receiving any solid residue which may pass through the grates 5, 6 and 8. While not shown, this residue area 11 could be equipped with a conveyor to transport the solid residues into the bunker 10. The gaseous discharge area processes the exhaust gases after the exhaust gases pass through the boiler section 9. Such a gaseous discharge area can preferably be provided with a filtering devices, such as an electrostatic precipitator 12 for removing particulate matter from the exhaust, and/or possibly a gas scrubber for removing or reacting any harmful gases from the exhaust before the exhaust is passed into the atmosphere through the stack 13.

This above-discussed system is meant to be exemplary of an incineration plant, and any variations on the components thereof would be well within the skill of the artisan.

The methods of moving waste through an incinerator are generally also well known, and the present invention will therefore be discussed in relation to one method which utilizes moving grates, as the mode of operation. However, it is also conceivable that the methods of the present invention can also be applicable to other refuse feed systems.

Figure 2:
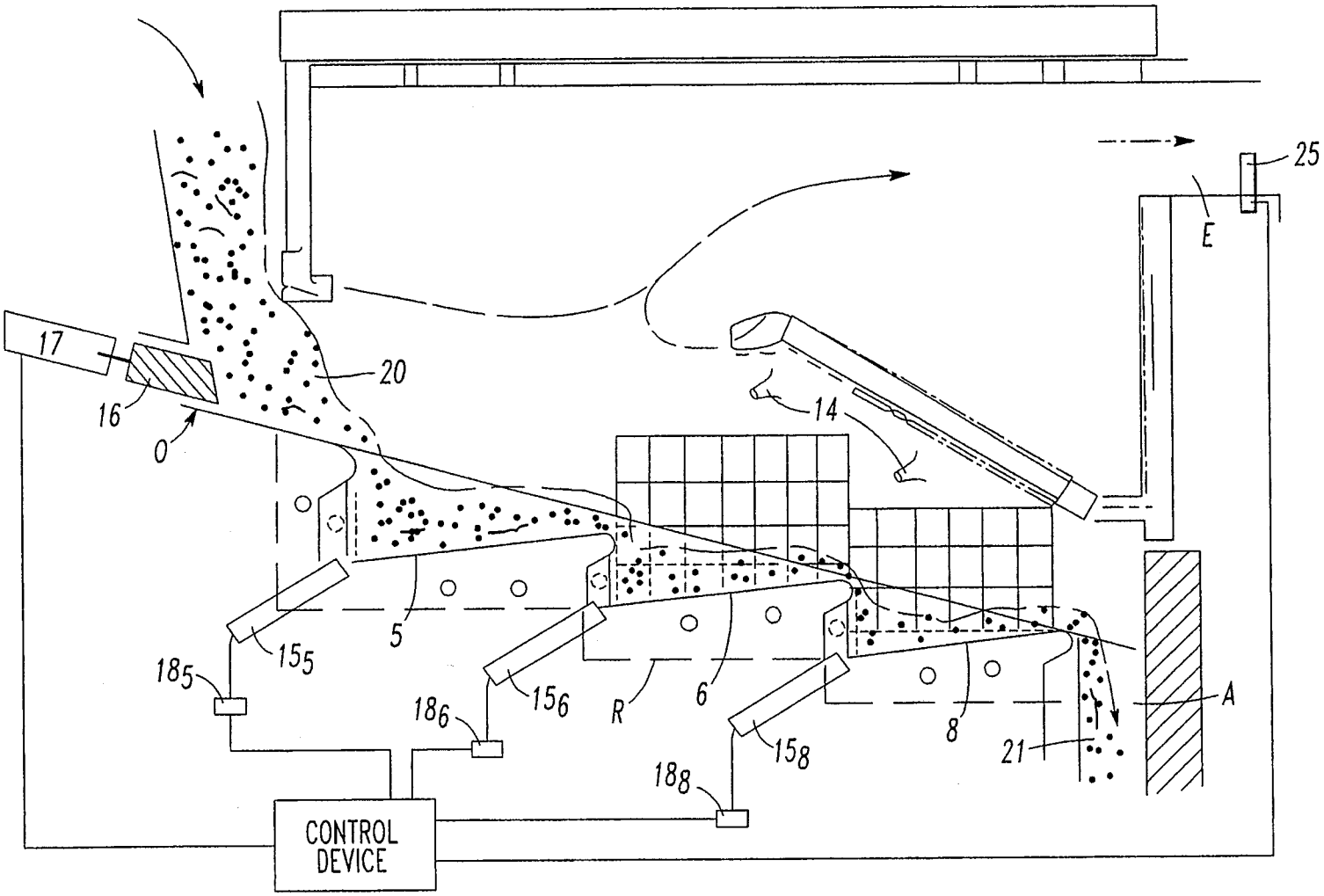
FIG. 2 is a general view of one type of refuse incinerator having hydraulically driven grates.

In general, an incineration system must provide support for the refuse, admit underfire air into the refuse bed, transport the refuse from the feed chute to the ash bunker, and even agitate the refuse to being fresh charge to the surface of the bed. One type of system which has been found to be efficient in satisfying these requirements has been found to be a moving grate system as shown in FIG. 2. In essence the grate system as shown in FIG. 2 can be utilized in the incinerator as depicted in FIG. 1. In a grate system as shown, the refuse 20 fed to the furnace is preferably first dried and preheated at the first grate 5 by radiation from the hot combustion gases and refractory furnace lining. The refuse, as it is heated further, for example on grate 6, first pyrolizes and then ignites. Combustion then takes place not only in the solid, to burn out the residue, but also in the gas space to burn out the pyrolisis products. For enhancing combustion in the air space, overfire air jets 14 can be provided to assist in the mixing of the gases.

FIG. 2 shows a typical refuse incinerator having a grate system R for feeding the refuse through the incinerator. In such an installation, there would generally be a loading zone 0 by means of which refuse 20 can be deposited into the incinerator, and an exit zone A for the burnt residues 21 to exit the incinerator. The grate system R can preferably have a number of consecutive grates 5, 6 and 8 similar to those shown in FIG. 1.

Any gases which are produced during the incineration can preferably exit out of the incinerator through the exit E. In the entry zone 0, there could preferably be a pushing bar 16 for pushing refuse 20 into the first grate zone 1. Such a pushing bar 16 can essentially ensure that there will be a supply of refuse to the grate zones, as gravity feed of the refuse can not always be relied upon due to possible clogging of the refuse chute.

Figure 3:
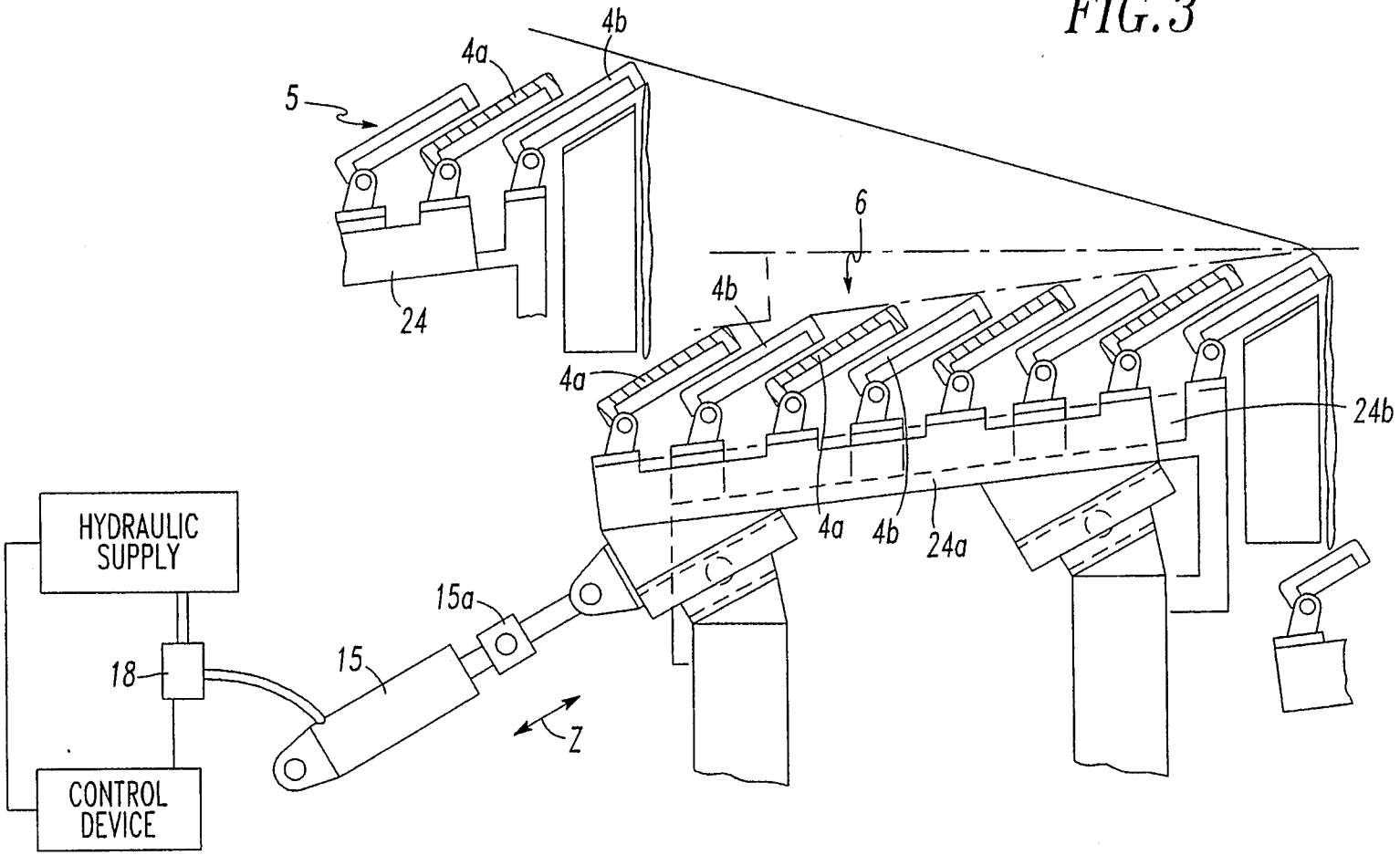
FIG. 3 shows a more detailed view of a grate system as can be used in the incinerator of FIG. 2.

Once the refuse reaches the grates 5, 6 and 8, the grates can then preferably be utilized to propagate the refuse through the incinerator. As shown in FIG. 3, the grates themselves can comprise two sets of grate components, stationary bars **4*b*, and slidable bars 4*a*, which can be mounted on support elements 24*b* and 24*a* respectively. A device can then be provided for moving the bars 4*a* relative to the bars 4*b* to push the refuse along within the incinerator. One such type of movement device could preferably be a hydraulic piston-cylinder 15 which has a piston 15*a* movable along the direction Z. As would generally occur with the device of FIG. 3, upon a movement of the hydraulic piston to the right, the support elements 24*a* would be displaced to the right relative to the support elements 24*b*, thereby causing the bars 4*a* to slide over the surfaces of the bars 4*b* and push any refuse on the grate to the right. A retraction of the hydraulic cylinder back to the left, would then return the bars 4*a*** to leftward position, wherein "new" refuse could fall into the vacated areas, for being pushed during the next cycle of operation.

As has been briefly discussed previously, one measure for determining the amount of refuse lying on a grate is the hydraulic pressure of the grate drive. For monitoring the hydraulic pressure at the hydraulic cylinder 15 of FIG. 3, a pressure monitor 8 could be provided. Alternately, if the system is equipped with three such grates as shown in FIGS. 1 and 2, each of the hydraulic cylinders $\mathbf{15}_5$, $\mathbf{15}_6$ and $\mathbf{15}_8$ for the grates 5, 6 and 8, respectively, could be provided with a separate pressure monitor $\mathbf{8}_5$, $\mathbf{8}_6$ and $\mathbf{18}_8$. In alternate embodiments, it may be preferable however to have possibly only one, or even two, such monitors when more than one grate is provided. It is further submitted that the number of grates used and the number of corresponding monitors 8 used in the context of the present invention would be variable and well within the skill of the artisan.

For a deep layer of refuse and a correspondingly large amount of refuse, a grate drive would normally require a higher hydraulic pressure than for a smaller quantity of refuse. With a hydraulic pressure monitor 8, the amount of pressure being used could be monitored, and relayed back to a control device, which could preferably be microprocessor unit. This control device could then signal the hydraulic supply to either increase or decrease the pressure so that the goal of having a constant refuse layer, or refuse amount, present on a grate could be achieved. The measurement and control technology which would provide such an effect is not discussed in great detail herein as such microprocessor control is known and would be readily available to one skilled in the art. It is also known that such control could be effected automatically by the microprocessor device upon the recipt of appropriate signals from the sensor units.

In accordance with the present invention, if the hydraulic pressure of the first grate 5, and therefore the quantity/depth of refuse, would decrease below a specified minimum value, the charging to that grate 5 could be increased by increasing the stroke speed of the pushing rod 16. Alternately, if the pressure and the corresponding amount of refuse increased beyond a specified maximum value, the charging could be reduced by reducing the stroke speed of the pushing rod 16. In this manner, an overloading or underloading of the grate can be substantially prevented.

On a grate system which has several grates, each with its own drive mechanisms, as illustrated in FIGS. 1 and 2, the quantity of refuse or the depth of the refuse at each of the individual grates can be regulated in a similar manner.

For example, if the hydraulic pressure of a grate, for example grate 6, is above/below an adjustable maximum/minimum value, the speed of the upstream grate, that is, grate 5, could be reduced/increased correspondingly, to thereby reduce or increase the speed of transport of the charge to the next grate, or grate 6.

As measurements on an existing refuse incineration system have shown, the maintenance of a more uniform depth of fuel on a grate can result in an incineration operation with significantly lower fluctuations of both steam and temperature.

A change in the speed of a grate zone, or, that is, of the grate bars within the grate zone, means that the number of cylinder strokes per unit of time is changed, which actually also changes the speed of movement of the individual bars. If measurements of the hydraulic pressure on the drive mechanism of the bars during the stroke movement required to transport the refuse, for example for the grate 6, show that the pressure for the grate 6 is decreasing, it could essentially be assumed that the depth of fuel on this grate 6 is also decreasing. To then reestablish a uniform layer, the number of strokes of at least the preceding grate 5 can then be increased, and if necessary the feed via the charging feeder 16 could also be increased, by means of suitable control device 17, until the pressure for the grate zone 2 once again falls between the specified maximum and minimum values.

It is preferable that the control system in accordance with the present invention allow the pressure and the limit values required for regulation to be set for the individual grate zones, to thereby enable optimal adjustment of the system depending on the type of fuel being burned.

In one exemplary usage of the present invention, it might be desirable to maintain approximately a twelve inch layer of refuse on grate 5, approximately a six inch layer of refuse on the grate 6, and approximately a three inch layer of refuse on the grate 8. These numbers are meant as examples only, and the actual depth may vary for each grate. For example, the depth on grate 5 could possible range anywhere from about 6 inches to 18 inches, the depth on grate 6 could possibly range anywhere from about 3 inches to 9 inches, and the depth on grate 8 could possibly range anywhere from about 1.5 inches to 4.5 inches. Alternately, the ratio of layer depths does not need to necessarily need to be ½ the thickness of the preceding layer, but other fractional values such as about ⅓ to about ⅔ could also be possible. It is submitted that the above layer depths would vary per incinerator installation, and optimum layer depths would need to be determined for each system.

One method for determining the optimum depth would be to set up a number of experimental runs configured to have different depths of refuse in the individual refuse zones within the incinerator, i.e., different depths on grates 5, 6 and 8. A combustion run could then be performed with the predetermined depths, while measuring the pollutants remaining in the exhaust gases, and also measuring the amount of particulates remaining after passage of the refuse through the incinerator. The results from such experimental runs could then be analyzed to provide optimum refuse depth and transport speeds through the incinerator. In essence, one is trying to minimize pollutants and ash by optimizing the refuse layer depth. Once the optimum layer depths have been determined, incineration of that particular type of refuse can then be carried out in accordance with the procedures provided by the present invention to provide constant operating conditions.

During the incineration in accordance with the present invention, it can also be preferable to monitor the pollutants to ensure that the operating conditions are being maintained at what could be considered to be optimum conditions for a refuse depth. Some of the pollutants which could be monitored include nitrogen oxides and carbon monoxide. As an example, it could preferably be beneficial to monitor the pollutants in the exhaust gas with one or more pollutant sensors 25, and if the pollutants, i.e. the carbon monoxide and nitrogen oxides, increase beyond a specified value, it could be speculated that a hole has formed in the refuse layer on the grate, and further control operations for the incineration could then be actuated, i.e., an increase in the thickness of the refuse layer being burned could be provided to again attain an optimum refuse depth. Also, if the ash amount per unit of refuse burned is found to be higher than normal, this could signify that insufficient burning is occurring within the incinerator. Therefore, the level of refuse per layer could be decreased to a lesser amount to provide a better burn per unit of refuse.

Such a combination of control features could essentially be automatically monitored by a computer processor, which processor could be interfaced with the pollutant sensors, the hydraulic pressure supply, the pressure monitors, etc. Since the components necessary for such a control and monitoring system are essentially known, further discussion thereabout is not included herein.

It should also be understood that other types of refuse depth monitors could also be used besides the hydraulic pressure monitor as discussed hereabove. For example, an array of optical detectors could be used to determine the height of the refuse layer, which array could have light emitters disposed on a first side of the refuse path, and receivers disposed on the opposite side, wherein the refuse present would block transmission of light between sensors lower than the refuse level, while sensor above the refuse level would receive transmitted light. Alternatively, optical triangulation using reflected light beams could also be used, while even more sophisticated technology using, for example, radar or sonic type devices could also be used. Some types of device which can be used for monitoring depth of refuse are disclosed by the following U.S. Pat. Nos.: 5,206,652 to Hoyt and Lanza entitled "Doppler Radar/Ultrasonic Hybrid Height Sensing System"; 5,061,935 to Sekine and Abe, entitled "Three-Dimensional Display Radar"; and 4,477,184 to Yokosuka, entitled "Obstacle Detection System"; 4,697,532 to Toshiharu et al. entitled "Operating Method for a Refuse Processing Furnace".

In addition, optical type sensors could also be used to monitor the ash being discharged from the incinerator. It is known that different size particles and different densities of ash will reflect light therefrom, or alternately block varying amount of light passing therethrough. Thus, for example, if a light beam is disposed in the discharge path, and sensors are disposed opposite to the light source, when the sensors indicate a decrease in the amount of light passing through the discharged ash, one could speculate that the burning is becoming insufficient and reduce the refuse layer to a new lower constant level.

There are essentially several types of sensors which can be used to monitor the exhaust gases, and are essentially well known in the art. In essence, it might be desirable to monitor at least one of: carbon dioxide, carbon monoxide, nitrogen oxides, chlorines, fluorines, PCB's, hydrocarbons or particulate matter, etc. It is also known that one can generally monitor oxygen presence to determine the oxides of nitrogen and carbon present. For example, some of the types of sensors which can be used include the sensors disclosed by the following U.S. Pat. Nos.: for carbon monoxide, 5,252,949 to Kirby et al, entitled "Chemical Sensor for Carbon Monoxide Detection"; 5,250,169 to Logothetis and Soltis, entitled "Apparatus for Sensing Hydrocarbons and Carbon Monoxide"; and 4,207,737 to Miyagi, entitled "Apparatus for controlling the Amount of Secondary Air Injection"; for nitrogen oxides, 5,034,112 to Murase et al., entitled "Device for Measuring Concentration of Nitrogen Oxide in Combustion Gas"; 4,816,749 to Schmidtpott and Wagner, entitled "Electrochemical Sensor; and the sensor disclosed by 3,974,040 to Siebke et al., entitled "Controls for Maintaining Low Nitrogen Oxides Content in Internal Combustion Engine Exhaust Gases"; for oxygen, 5,230,293 to Schirmer, entitled "Method and Apparatus for Controlling a Refuse Incineration Plant"; 5,245,979 to Pursifull et al., entitled "Oxygen Sensor System with a Dynamic Heater Malfunction Detector"; and 4,870,912 to Lee, entitled "Automatic Combustion Control Method for a Rotary Combustor"; for chlorine, PCB's, or fluorine, 4,097,356 to Yates, entitled "Chlorine Generator"; 5,254,797 to Imoto et al., entitled "Method of Treating Exhaust Gas"; 4,472,363 to Poller and Weinzierl, entitled "Process for the Separation of Chlorine, Fluorine and Sulphur from Fuel Gas and Flue or Exhaust Gas"; and 4,944,921 to Colby and Burns, entitled "Automated PCB Analyzer System"; and for carbon dioxide, a sensor such as that for 5,246,859 to Nelson et al., entitled "Method of stabilizing a Carbon Dioxide Sensor"; and 5,079,422 to Wong, entitled "Fire Detection System Using Spatially Cooperative Multi-Sensor Imput Technique"; and for hydrocarbons, 4,747,297 to Okayama et al., entitled "Apparatus for Analyzing Particulates".

In essence, any of the above-listed patents, and any reference articles which may be listed in such patents show that such apparatus and processes discussed therein are generally known in the art, and can be used as background information for the disclosure of the present invention.

One feature of the invention resides broadly in the process to regulate the quantity of refuse or the depth of the refuse layer on incinerator grates, characterized by the fact that the charging of the grate and the speed of the grate are regulated as a function of the quantity of refuse on the grate.

Another feature of the invention resides broadly in the process, characterized by the fact that the hydraulic pressure of the grate drive mechanism is utilized by the measurement and control system.

Yet another feature of the invention resides broadly in the process, characterized by the fact that the charging is controlled by means of the feeder as a function of the hydraulic pressure of the first grate zone.

Still another feature of the invention resides broadly in the process, characterized by the fact that the speed of a grate zone is regulated on the basis of the hydraulic pressure of a downstream grate zone.

Still yet another feature of the invention resides broadly in the process, characterized by the fact that the speed of a grate zone is regulated on the basis of its own hydraulic pressure.

Yet still another feature of the invention resides broadly in the process, characterized by the fact that the regulated hydraulic pressure of a grate zone can be adjusted.

Some additional patents which discuss in more detail apparatus and processes for control of combustion and incineration of refuse, in general are disclosed by the following U.S. Pat. Nos.: 4,676,176 to Bonomelli, entitled "Furnace Grate"; 4,471,704 to John et al., entitled "Reciprocating Grate Systems for Furnaces and Incinerators"; 4,320,710 to Steiner and Erbsland, entitled "Grate Mechanism for Incinerating Furnace"; and 4,170,183 to Cross, entitled "Incinerating Method and Apparatus Having Selective, Controlled Movement of Materials During Combustion".

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference for at least providing non-essential background information, as if set forth in their entirety herein.

The corresponding foreign patent publication applications, namely, Federal Republic of Germany Patent Application No. P 42 15 997, filed May 13, 1992, having inventors Ullrich Kaiser, Erwin Wachter, Gert Lautenschlager, Robert Steiner, and Bernd Fabian, and DE-OS P 42 15 997 and DE-PS 42 15 997, and International Application No. PCT/DE 93/00400, as well as their published equivalents, and other equivalents or corresponding applications, if any, in corresponding cases in the Federal Republic of Germany and elsewhere, and the references cited in the corresponding PCT search report, are hereby incorporated by reference for at least providing non-essential background information, as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for incinerating refuse in an incineration apparatus to minimize pollutants in the exhaust and minimizes ash produced during the incineration$_d$ the incineration apparatus comprising at least one zone therein for incinerating refuse, and means for substantially continuously feeding refuse through said at least one incineration zone$_d$ said method comprising the steps of:

predetermining a substantially optimum quantity of refuse to be present in said at least one incineration zone for said incineration, said substantially optimum quantity being a quantity which minimizes ash and exhaust pollutants produced during said incineration;

providing refuse to the incineration apparatus;

substantially continuously charging an amount of refuse into said at least one incineration zone;

substantially continuously feeding the refuse charge through said at least one incineration zone at a speed of refuse transport;

measuring the quantity of refuse in said at least one incineration zone, said measuring of the quantity of refuse comprising measuring a load needed to drive said feeding means, said substantially optimum quantity of refuse corresponding to a predetermined range of load values;

incinerating the refuse in the incineration apparatus to produce ash and exhaust gases;

regulating at least one of:

said charging of refuse into said at least one incineration zone, and said feeding speed through said at least one incineration zone as a function of the quantity of refuse measured in said at least one incineration zone; and maintaining said substantially optimum quantity of refuse in said at least one incineration zone by said regulating of at least one of: said charging and said feeding speed, to minimize ash and exhaust pollutants produced by said incineration.

2. The method according to claim 1, wherein said maintaining of said substantially optimum quantity of refuse comprises:

upon the load falling below a first predetermined load value, at least one of:

increasing said charging; and decreasing said feeding speed to increase the quantity of refuse in said at least one incineration zone; and upon the load rising above a second predetermined load value, at least one of:

decreasing said charging; and increasing said feeding speed to decrease the quantity of refuse in said at least one incineration zone.

3. The method according to claim 2, wherein said predetermining of the substantially optimum quantity of refuse to be present in said at least one incineration zone for said incineration comprises:

conducting a plurality of incineration burns with a plurality of varying quantities of refuse present in said at least one incineration zone;

measuring for each of said plurality of incineration burns, the pollutants present in the exhaust gas and the amount of ash produced;

correlating the amount of pollutants present in the exhaust gas and the amount of ash produced with the plurality of varying quantities of refuse present; and selecting a refuse quantity from said plurality of varying quantities corresponding to a substantially minimized amount of pollutants present and ash produced as said substantially optimum refuse quantity.

4. The method according to claim 3, wherein:

said at least one incineration zone comprises at least one incineration grate within said incineration apparatus;

said at least one incineration grate comprising a plurality of bars;

said plurality of bars comprising a first set of said plurality of bars and a second set of said plurality of bars;

said first set of said plurality of bars being displaceable with respect to said first set of said plurality of bars to feed refuse along said first set of said plurality of bars;

said feeding means comprise means for repeatedly displacing said first set of said plurality of bars with respect to said second set of said plurality of bars; and said feeding speed comprises a number of displacement strokes of said first set of said plurality of bars per unit of time.

5. The method according to claim 4, wherein:

said means for displacing comprises hydraulic drive means for displacing said first set of said plurality of bars with respect to said second set of said plurality of bars; and said measuring of the load comprises measuring a hydraulic pressure needed to drive said hydraulic drive means.

6. The method according to claim 5, wherein:

said incineration apparatus further comprises a charging feeder operating at a charging rate;

said charging comprises charging an amount of refuse onto said at least one incineration grate; and said regulating of said charging onto said at least one incineration grate comprises:

measuring the hydraulic pressure of said hydraulic drive means of said at least one incineration grate; and increasing said charging rate of said charging feeder upon the hydraulic pressure in said at least one incineration zone falling below a minimum pressure value; and decreasing said charging rate of said charging feeder upon the hydraulic pressure in said at least one incineration zone rising above a maximum pressure value.

7. The method according to claim 6, wherein:

said at least one incineration zone comprises at least first and second incineration zones, said second incineration zone being disposed consecutively adjacent and after said first incineration zone in a feed direction of refuse within said incineration apparatus, said first incineration zone comprising a refuse drying zone and said second incineration zone comprising a refuse burning zone;

each of said first and second incineration zones comprises an incineration grate with hydraulic drives means for operating said incineration grate, each said incineration grate having a feeding speed for transporting refuse along the corresponding incineration grate within each of said first and second incineration zones; and said method further comprises the steps of:

measuring the hydraulic pressure in each of said first and second incineration zones; and regulating the feeding speed of said incineration grate in said first incineration zone as a function of the hydraulic pressure in said second incineration zone, said regulating comprising:

increasing said feeding speed in said first incineration zone upon the hydraulic pressure in said second incineration zone falling below the minimum pressure value; and decreasing said feeding speed in said first incineration zone upon the hydraulic pressure in said second incineration zone rising above the maximum pressure value.

8. The method according to claim 7, wherein:

said incineration apparatus further includes a third incineration zone disposed adjacent said second incineration zone and after said second incineration zone in said direction of travel of the refuse through the incineration apparatus, said third incineration zone comprising a burnout zone;

said third incineration zone comprises an incineration grate with hydraulic drives means for operating said incineration grate, said incineration grate of said third zone also having a feeding speed for transporting refuse along the corresponding incineration grate within said third zone; and said method further comprises:

measuring the hydraulic pressure in each of said first, second and third incineration zones; and regulating the feeding speed of said incineration grate in a previous incineration zone as a function of the hydraulic pressure in a subsequent incineration zone, said regulating comprising.

9. The method according to claim 8, wherein said incineration apparatus further comprises sensor means for monitoring at least one pollutant in the exhaust gas, and sensor means for monitoring an amount of ash produced during said incineration, and said incineration further comprises:

monitoring at least one pollutant in the exhaust gas during said incineration, the at least one pollutant comprising at least one member from the group consisting of: nitrogen oxides, carbon monoxide, carbon dioxide, chlorine, fluorine, chlorinated organics and fluorinated organics;

setting new pressure load parameters for the refuse quantity when an amount of said at least one monitored pollutant in the exhaust gas increases beyond a predetermined value, said predetermined value comprising an environmentally safe value;

monitoring an amount of ash produced during said incineration; and setting new pressure load parameters for the refuse quantity when the amount of ash produced per unit of refuse increases above a predetermined value.

10. The method according to claim 9, wherein:

said incineration is for incinerating trash produced in homes;

said incineration generates heat, and said heat generated is used for heating water to produce steam, the steam being usable to generate work;

said maintaining of a substantially optimum quantity of refuse in said incineration zones comprises maintaining the quantity of refuse above a minimum value to minimize formation of holes in the refuse layer during incineration, and maintaining the quantity of refuse below a maximum value to minimize ash residue remaining after incineration;

said incineration further comprises at least one of:

filtering the exhaust gases to remove particulate ash therefrom; and reacting nitrogen oxides and carbon monoxide to remove the nitrogen oxide and carbon monoxide from the exhaust; and said optimum quantity of refuse drying in said first grate zone is about twice the quantity of refuse burning in said second zone, and said quantity of refuse burning in said second zone is about twice the quantity of substantially burnt refuse in said third zone.

11. The method according to claim 6, wherein:

said at least one incineration zone comprises at least first and second incineration zones, said second incineration zone being disposed consecutively adjacent and after said first incineration zone in a feed direction of refuse within said incineration apparatus;

each of said first and second incineration zones comprises an incineration grate with hydraulic drives means for operating said incineration grate, each said incineration grate having a feeding speed for transporting refuse along the corresponding incineration grate within each of said first and second incineration zones; and said method further comprises the steps of:

measuring the hydraulic pressure in each of said first and second incineration zones; and regulating the feeding speed of said incineration grate in said first incineration zone as a function of the hydraulic pressure in said first incineration zone, and regulating the feeding speed of said incineration grate in said second incineration zone as a function of the hydraulic pressure in said second incineration zone;

in each of said first and said second incineration zones, said regulating comprising:

decreasing said feeding speed in said incineration zone upon the hydraulic pressure in said corresponding incineration zone falling below the minimum pressure value; and increasing said feeding speed in said incineration zone upon the hydraulic pressure in said corresponding incineration zone rising above the maximum pressure value.

12. The method according to claim 11, wherein:

said incineration apparatus further comprises sensor means for monitoring at least one pollutant in the exhaust gas, and sensor means for monitoring an amount of ash produced during said incineration;

said incineration further comprises:

monitoring at least one pollutant in the exhaust gas during said incineration, the at least one pollutant comprising at least one member from the group consisting of: nitrogen oxides, carbon monoxide, carbon dioxide, chlorine, fluorine, chlorinated organics and fluorinated organics;

setting new pressure load parameters for the refuse quantity when an amount of said at least one monitored pollutant in the exhaust gas increases beyond a predetermined value, said predetermined value comprising an environmentally safe value;

monitoring an amount of ash produced during said incineration; and setting new pressure load parameters for the refuse quantity when the amount of ash produced per unit of refuse increases above a predetermined value; said incineration is for incinerating trash produced in homes;

said incineration generates heat, and said heat generated is used for heating water to produce steam, the steam being usable to generate work;

said maintaining of a substantially optimum quantity of refuse in said incineration zones comprises maintaining the quantity of refuse above a minimum value to minimize formation of holes in the refuse layer during incineration, and maintaining the quantity of refuse below a maximum value to minimize ash residue remaining after incineration;

said incineration further comprises at least one of:

filtering the exhaust gases to remove particulate ash therefrom; and reacting nitrogen oxides and carbon monoxide to remove the nitrogen oxide and carbon monoxide from the exhaust; and said optimum quantity of refuse drying in said first grate zone is about twice the quantity of refuse burning in said second zone, and said quantity of refuse burning in said second zone is about twice the quantity of substantially burnt refuse in said third zone.

13. A process for regulating a quantity of refuse or a depth of a refuse layer on at least a first incinerator grate of an incinerator for incinerating refuse, said incinerator comprising means for feeding refuse along said first incinerator grate, said process comprising:

charging an amount of refuse onto said first incinerator grate;

feeding the refuse charge along said first incinerator grate at a speed of refuse transport during said incineration;

measuring the quantity of refuse on said first incinerator grate, said measuring of the quantity of refuse comprising a load needed to drive said feeding means;

regulating at least one of:

said charging of refuse onto said first incinerator grate, and said feeding speed along said first incinerator grate as a function of the quantity of refuse measured on said first incinerator grate;

maintaining a substantially constant quantity of refuse on said first incinerator grate during said incineration by said regulating of at least one of: said charging of refuse onto said first incinerator grate and said feeding speed along said first incinerator grate to minimize ash and exhaust pollutants produced by said incineration;

said substantially constant quantity of refuse corresponding to a range of load values for said feeding means; and said maintaining of said substantially constant quantity of refuse on said first incinerator grate comprises:

upon the load falling below a minimum value of said range of load values, at least one of:

increasing said charging; and decreasing said feeding speed to increase the quantity of refuse on said first incinerator grate; and upon the load rising above a maximum value of said range of load values, at least one of:

decreasing said charging; and increasing said feeding speed to decrease the quantity of refuse in said at least one incineration zone.

14. The method according to claim 13, wherein:

said at least one incineration grate comprising a plurality of bars, said plurality of bars comprising a first set of said plurality of bars and a second set of said plurality of bars;

said first set of said plurality of bars being displaceable with respect to said first set of said plurality of bars to feed refuse along said first set of said plurality of bars;

said feeding means comprises hydraulic drive means for repeatedly displacing said first set of said plurality of bars with respect to said second set of said plurality of bars, said feeding speed comprises a number of displacement strokes of said first set of said plurality of bars per unit of time; and said measuring of the load comprises measuring a hydraulic pressure needed to drive said hydraulic drive means.

15. The method according to claim 14, wherein:

said incineration apparatus further comprises a charging feeder operating at a charging rate;

said charging comprises charging an amount of refuse onto said first incinerator grate; and said regulating of said charging onto said first incinerator grate comprises:

measuring the hydraulic pressure of said hydraulic drive means of said first incinerator grate; and increasing said charging rate of said charging feeder upon the hydraulic pressure for said first incinerator grate falling below a minimum pressure value; and decreasing said charging rate of said charging feeder upon the hydraulic pressure for said first incinerator grate rising above a maximum pressure value.

16. The method according to claim 15, wherein:

said incinerator comprises at least first, second and third incinerator grates disposed consecutively adjacent and after one another in a feed direction of refuse within said incinerator, said first incinerator grate comprising a grate for drying refuse thereon, said second incinerator grate comprises a grate for burning refuse thereon, and said third incinerator grate comprises a grate for burning-out refuse disposed thereon;

each of said first, second, and third incinerator grates comprises hydraulic drives means for operating said corresponding incinerator grate, each said incinerator grate having a corresponding feeding speed for transporting refuse along the corresponding incineration grate; and said method further comprises the steps of:

measuring the hydraulic pressure for each of said first, second and third incinerator grates; and regulating the feeding speed for a previous incinerator grate as a function of the hydraulic pressure for a subsequent incinerator grate, said regulating comprising:

increasing said feeding speed for said previous incinerator grate upon the hydraulic pressure for said subsequent incinerator grate falling below the minimum pressure value; and decreasing said feeding speed for said first incinerator grate upon the hydraulic pressure for said second incinerator grate rising above a maximum pressure value.

17. The method according to claim 15, wherein:

said incinerator comprises at least first, second and third incinerator grates disposed consecutively adjacent and after one another in a feed direction of refuse within said incinerator, said first incinerator grate comprising a grate for drying refuse thereon, said second incinerator grate comprises a grate for burning refuse thereon, and said third incinerator grate comprises a grate for burning-out refuse disposed thereon;

each of said first, second, and third incinerator grates comprises hydraulic drives means for operating said corresponding incinerator grate, each said incinerator grate having a corresponding feeding speed for transporting refuse along the corresponding incineration grate; and said method further comprises the steps of:

measuring the hydraulic pressure for each of said first, second and third incinerator grates; and regulating the feeding speed for each of said first, second, and third incinerator grates as a function of the hydraulic pressure for that respective incinerator grate, said regulating comprising:

decreasing said feeding speed for said first, second and third incinerator grates upon the hydraulic pressure for that respective incinerator grate falling below the minimum pressure value; and increasing said feeding speed for said first, second, and third incinerator grate upon the hydraulic pressure for that respective incinerator grate rising above a maximum pressure value.

* * * * *

UNITED STATES PATENT AND TRADEMARK OFFICE

CERTIFICATE OF CORRECTION

PATENT NO. : 5,398,623

DATED : March 21, 1995

INVENTOR(S) : Gert LAUTENSCHLAGER, Ulrich KAISER, Robert STEINER, Erwin WACHTER and Bernhard FABIAN It is certified that error appears in the above-indentified patent and that said Letters Patent is hereby corrected as shown below:

On the title page, item [75], after 'Lautenschlager,', delete "Margetschöchheim;" and insert --Margetshöchheim;--.

In column 10, line 16, Claim 1, after the first occurrence of 'the', delete "incineration$_d$" and insert --incineration,--.

In column 10, line 20, Claim 1, after 'incineration', delete "zone$_d$" and insert --zone,--.

Signed and Sealed this

Seventeenth Day of December, 1996

*Attest:*

*Attesting Officer*

BRUCE LEHMAN

*Commissioner of Patents and Trademarks*